US007172433B2

(12) United States Patent
Tsai

(10) Patent No.: US 7,172,433 B2
(45) Date of Patent: Feb. 6, 2007

(54) ELECTRICAL CONNECTOR HAVING ELASTIC TERMINALS WITH CONTACTS LOCATED AT THE SAME LEVEL

(76) Inventor: Chou Hsuan Tsai, 15F, No. 4, Lane 127, Sec. 1, Fu-Hsing Rd., Hsin-Chuang City, Taipei Hsien (TW)

( * ) Notice: Subject to any disclaimer, the term of this patent is extended or adjusted under 35 U.S.C. 154(b) by 0 days.

(21) Appl. No.: 11/355,775

(22) Filed: Feb. 15, 2006

(65) Prior Publication Data

US 2006/0199403 A1 Sep. 7, 2006

(51) Int. Cl.
*H01R 12/00* (2006.01)

(52) U.S. Cl. ..... 439/74; 439/660

(58) Field of Classification Search ..... 439/65, 439/74, 660

See application file for complete search history.

(56) References Cited

U.S. PATENT DOCUMENTS 6,338,630 B1 * 1/2002 Dong ..... 439/74
6,811,411 B1 * 11/2004 Hirata et al. ..... 439/74
2001/0027036 A1 * 10/2001 Goto ..... 439/74
2005/0042899 A1 * 2/2005 Zhang ..... 439/74
2005/0101163 A1 * 5/2005 Obikane et al. ..... 439/74

* cited by examiner

*Primary Examiner*—Thanh-Tam Le
(74) *Attorney, Agent, or Firm*—Pro-Techtor Int'l Services

(57) ABSTRACT

An electrical connector includes a base and a plurality of terminals. The base has a plurality of separately disposed terminal slots. The terminals are respectively assembled in the terminal slots of the base and integrally formed by pressing a metal sheet. Each of the terminals includes an elastic arm having a projecting contact, a fixing portion fixed in the terminal slot, and a pin portion extending out of the base. The base is formed with a resting surface corresponding to each of the terminal slots. The elastic arm of the terminal is formed with a laterally protruding supporting foot resting against the resting surface of the base to make the contacts of the terminals be located at the same level.

9 Claims, 3 Drawing Sheets

ELECTRICAL CONNECTOR HAVING ELASTIC TERMINALS WITH CONTACTS LOCATED AT THE SAME LEVEL

BACKGROUND OF THE INVENTION

1. Field of the Invention

The invention relates to an electrical connector, and more particularly to an electrical connector having elastic terminals with contacts located at the same level.

2. Description of the Related Art

Referring to FIGS. 1 and 2, a conventional electrical connector to be connected to two circuit boards includes a male base 10, a plurality of male terminals 17, a female base 23, a plurality of female terminals 28. The male base 10 has a central portion 11 and a peripheral portion 12. The central portion 11 and the peripheral portion 12 form two concave portions 13. The peripheral portion 12 has separately disposed male terminal mounting slots 14. Two sides of the central portion 11 have separately disposed male terminal moving slots 15.

The male terminals 17 are assembled on the male base 10 and are formed by pressing a metal sheet. Each male terminal 17 includes an elastic arm 18, a fixing portion 21 and a pin portion 20. The elastic arm 18 is curved from bottom to top and may be elastically moved in the male terminal moving slot 15. The elastic arm 18 has a contact 19 projecting over the male terminal moving slot 15. The fixing portion 21 extending from bottom to top is inserted into and thus fixed in the male terminal mounting slot 14. The pin portion 20 is perpendicular to the fixing portion and extends out of the male base 10 horizontally.

The female base 23 has a concave portion 24 at a middle part thereof and a plurality of separately disposed female terminal slots 25 at two sides thereof. When the female base 23 and the male base 10 are assembled, two sides of the female base 23 are fit with the two concave portions 13 of the male base 10, ad the central portion 11 of the male base is fit with the concave portion 24 at the middle of the female base 23.

The female terminals 28 are assembled in the female terminal slots 25 of the female base 23. Each female terminal 28 is formed, by bending a metal sheet, to include a fixing portion 29, a contact sheet 30 and a pin portion 31. The fixing portion 29 is fixed in the female terminal slot 25. The contact sheet 30 is connected to one end of the fixing portion 29 and is stacked with the fixing portion 29. The pin portion 31 is connected to the other end of the fixing portion 29 and extends out of the female base 23 horizontally.

As shown in FIG. 2, after the female base 23 is connected to the male base 10, the contact 19 of the male terminal 17 elastically contacts the contact sheet 30 of the female terminal 28 to form the electrical connection. Thus, the pin portion 31 of the female terminal is connected to a first circuit board 33, while the pin portion 20 of the male terminal is connected to a second circuit board 34 such that the first circuit board 33 and the second circuit board 34 are electrically connected to each other.

The prior art electrical connector still has the following drawbacks. The electrical connection is created according to the elastic contact of the elastically moved elastic arm of the male terminal 17. However, the levels of the contacts 19 may be different from one another if the assembled depths of the male terminals 17 are different from one another. In addition, the skew caused in the pressing process or caused by the collision also makes the levels of the contacts of the terminals different.

SUMMARY OF THE INVENTION

It is therefore an object of the invention to provide an electrical connector having contacts of elastic terminals located at the same level to achieve the good electrical connection effect.

The invention achieves the above-identified object by providing an electrical connector comprising a female base, a plurality of female terminals, a male base and a plurality of male terminals. The female base is formed with a concave portion and a plurality of separately disposed female terminal slots. The female terminals are respectively assembled in the female terminal slots of the female base and are integrally formed by pressing a metal sheet. Each of the female terminals includes a contact, a fixing portion fixed in the female terminal slot, and a pin portion extending out of the female base. The male base has a central portion assembled in the concave portion of the female base and is formed with a plurality of separately disposed male terminal slots. The male terminals are respectively assembled in the male terminal slots of the male base and are integrally formed by pressing another metal sheet. Each of the male terminals includes an elastic arm having a projecting contact to be electrically connected to the contact of the female terminal, a fixing portion fixed in the male terminal slot, and a pin portion extending out of the male base. The central portion of the male base is formed with one resting surface corresponding to each of the male terminal slots. The elastic arm of the male terminal is formed with a laterally protruding supporting foot resting against the resting surface of the male base to make the contacts of the male terminals be located at the same level.

The invention also achieves the above-identified object by providing an electrical connector including a base and a plurality of terminals. The base has a plurality of separately disposed terminal slots. The terminals are respectively assembled in the terminal slots of the base and integrally formed by pressing a metal sheet. Each of the terminals includes an elastic arm having a projecting contact, a fixing portion fixed in the terminal slot, and a pin portion extending out of the base. The base is formed with a resting surface corresponding to each of the terminal slots. The elastic arm of the terminal is formed with a laterally protruding supporting foot resting against the resting surface of the base to make the contacts of the terminals be located at the same level.

Other objects, features, and advantages of the invention will become apparent from the following detailed description of the preferred but non-limiting embodiments. The following description is made with reference to the accompanying drawings.

DETAILED DESCRIPTION OF THE INVENTION

Figure 1:
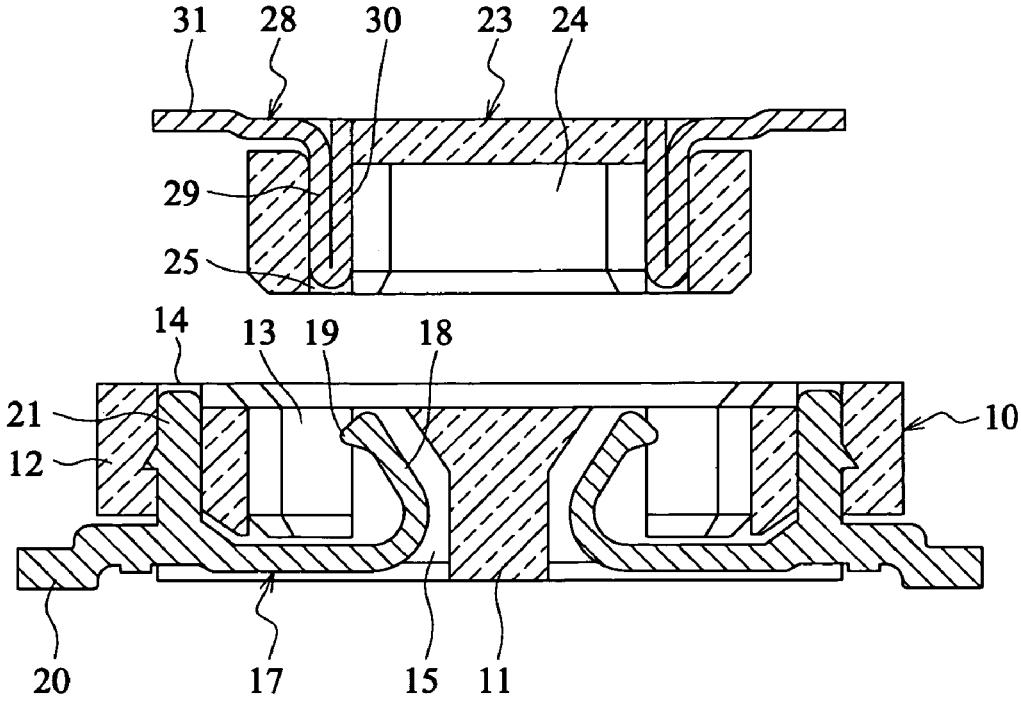
FIG. 1 (PRIOR ART)
FIG. 1 is a schematically exploded, cross-sectional view showing a conventional electrical connector.
Figure 2:
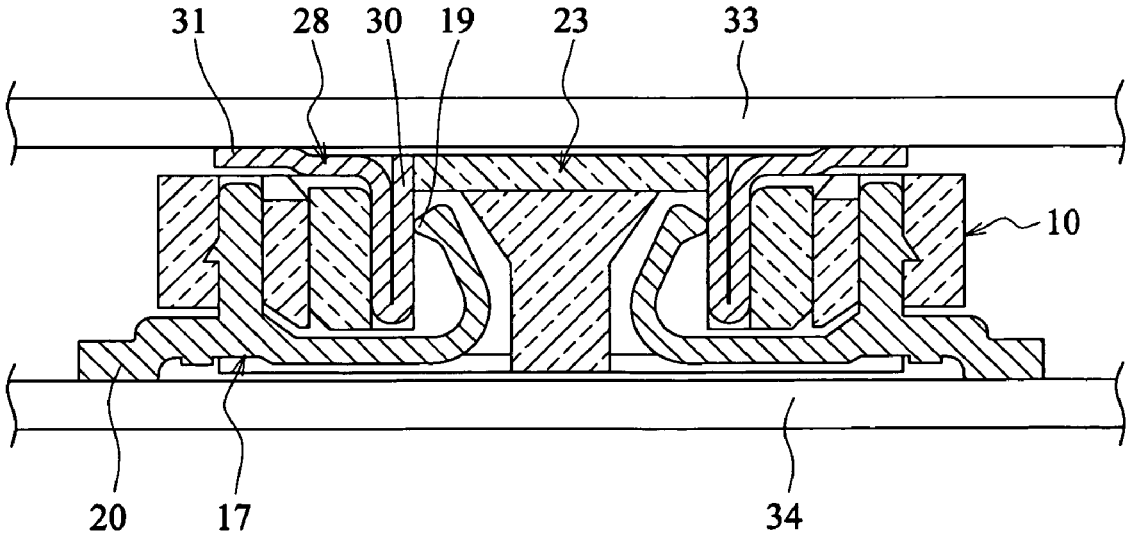
FIG. 2 (PRIOR ART)
FIG. 2 is a schematically cross-sectional view showing a usage state of the conventional electrical connector.
Figure 3:
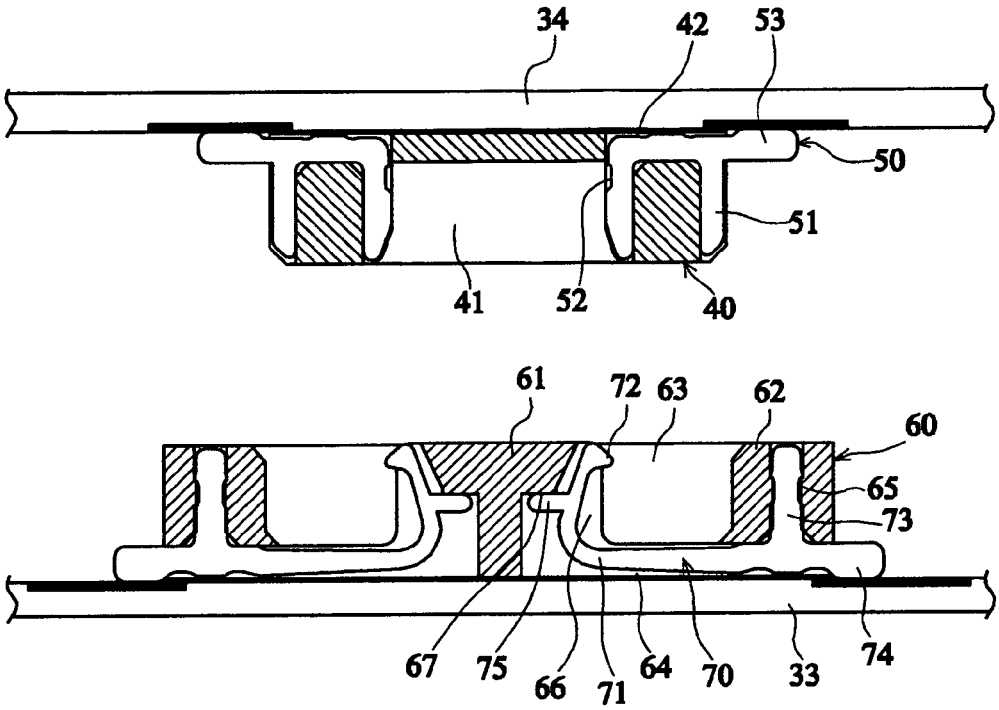
FIG. 3 is a cross-sectional, exploded view showing an electrical connector according to a preferred embodiment of the invention.
Figure 4:
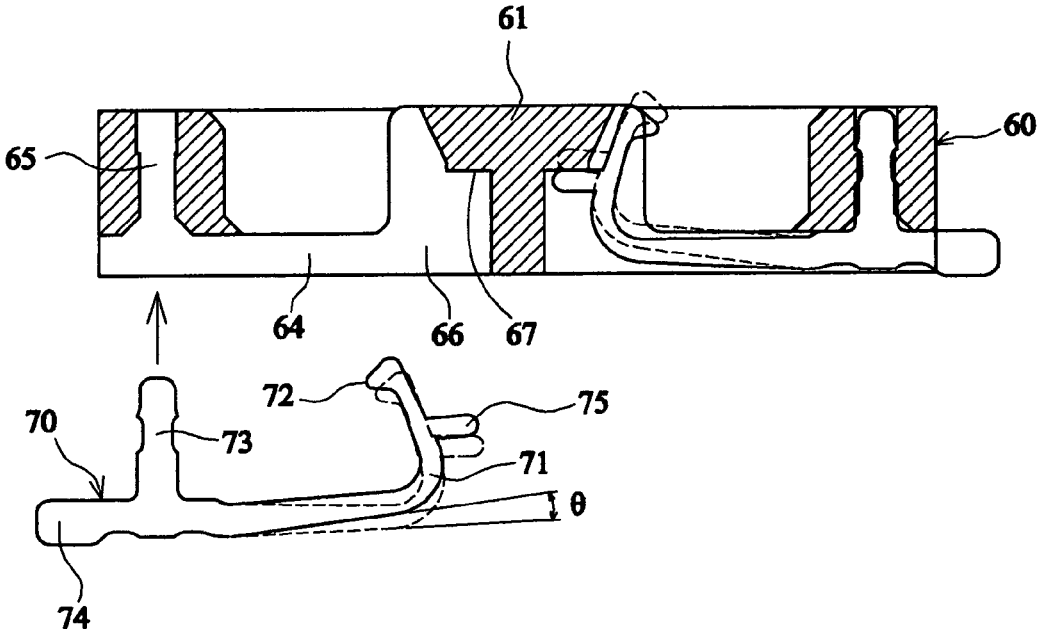
FIG. 4 is a cross-sectional, exploded view showing a male base and a male terminal according to the preferred embodiment of the invention.
Figure 5:
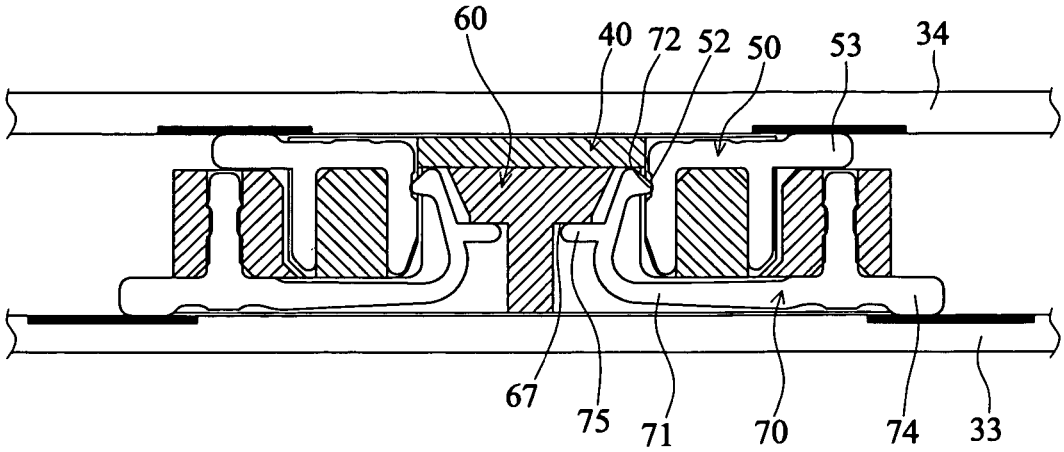
FIG. 5 is a cross-sectional, assembled view showing the electrical connector according to the preferred embodiment of the invention.

Referring to FIGS. 3 to 5, the electrical connector according to the preferred embodiment of the invention includes a female base 40, a plurality of female terminals 50, a male base 60 and a plurality of male terminals 70.

The middle of the female base 40 is formed with a concave portion 41. Two sides of the female base 40 are formed with a plurality of separately disposed female terminal slots 42.

The female terminals 50 are assembled in the female terminal slots 42 of the female base 40. The female terminals 50 are integrally formed by pressing a metal sheet and each female terminal 50 includes a U-shaped fixing portion 51 fit with the female terminal slot 42, a contact 52 nearer to the middle of the female base 40 than the fixing portion 51, and a pin portion 53 connected to a top of the outer side of the fixing portion 51 and extending out of the female base 40 horizontally.

The male base 60 has a central portion 61 and a peripheral portion 62. The central portion 61 and the peripheral portion 62 form two concave portions 63. Several separately disposed male terminal slots 64 are disposed at two sides of the lower end of the male base 60. The male terminal slot 64 includes a mounting slot 65 extending into the middle of the peripheral portion 62, and a moving slot 66 at one side of the central portion 61. The central portion 61 is formed with a horizontal resting surface 67 corresponding to the moving slot 66 of each male terminal slot.

When the male base 60 and the female base 40 are combined together, two sides of the female base 40 are fit with the concave portions 63 of the male base 60, respectively, and the central portion 61 of the male base 60 is fit with the concave portion 41 at the middle of the female base 40.

The male terminals 70 are respectively assembled in the male terminal slots 61 of the male base 60. Each male terminal 70 is formed by pressing a metal sheet and includes an elastic arm 71, a fixing portion 73, a pin portion 74 and a supporting foot 75. The elastic arm 71, which is bent from bottom to top, may be elastically moved in the moving slot 66 of the male terminal slot. The elastic arm 71 has a contact 72, which is near to the distal end of the elastic arm 71 and protrudes out of the moving slot 66. The fixing portion 73, which extends from bottom to top, is inserted into and then fixed in the mounting slot 65 of the male terminal slot. The pin portion 74 is perpendicular to the fixing portion 73 and horizontally extends out of the male base 10. The supporting foot 75, which is disposed at a side of the elastic arm 71, rests against the resting surface 67 of the male base 60 such that the contacts 72 of the male terminals are located at the same level. In addition, the elastic arm 71 is formed with an upward pre-pressing angle θ such that the elastic arm 71 has the force of pre-pressing the resting surface 67 of the base. Thus, it is possible to ensure the supporting feet 75 of the male terminals to rest against the resting surfaces 67 and to make the contacts 72 of the male terminals be located at the same level.

As shown in FIG. 5, the contact 72 of the male terminal 70 elastically contacts the contact 52 of the female terminal 50 after the male base 60 is combined with the female base 40. Thus, the pin portion 74 of the male terminal is connected to the first circuit board 33, and the pin portion 53 of the female terminal is connected with the second circuit board 34 such that the first circuit board 33 is electrically connected to the second circuit board 34.

Figure 6:
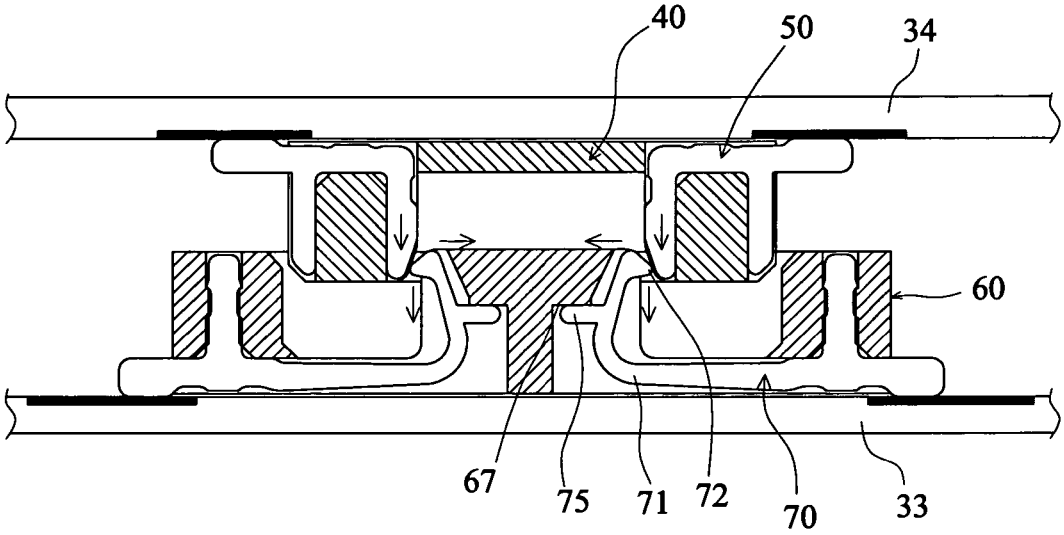
FIGS. 6 and 7 show usage states of the electrical connector according to the preferred embodiment of the invention.
Figure 7:
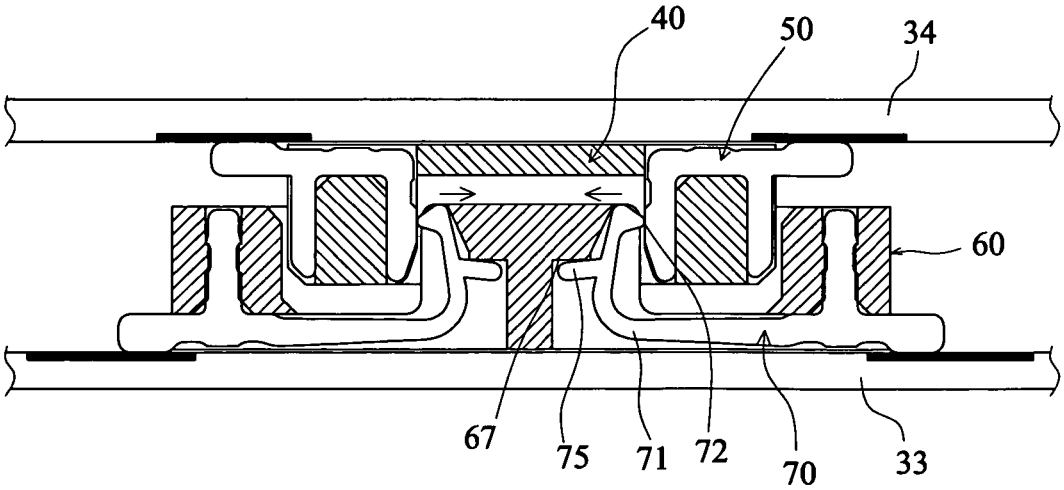

As shown in FIGS. 6 and 7, when the male base 60 is combined with the female base 40 upwards, the elastic arm 71 produces the downward and inward components of force when the female terminal 50 contacts the contact 72 of the male terminal. Because the elastic arm 71 has an upward pre-pressing angle and thus the force of pre-pressing the resting surface 67 of the base, the elastic arm 71 of the male terminal 70 is only caused to move inwards but not downwards to touch the first circuit board 33 when the male base 60 is combined with the female base 40.

The invention has the following advantages.

1. The elastic arm 71 of the male terminal 70 has a laterally protruding supporting foot 75, which rests against the resting surface 67 of the male base. So, the contacts of the male terminals are located at the same level.

2. The elastic arm 71 of the male terminal 70 has an upward pre-pressing angle θ and thus the force of pre-pressing the resting surface 67 of the base. Thus, it is possible to ensure that the supporting feet 75 of the male terminals 70 rest against the resting surface 67.

3. The elastic arm 71 has an upward pre-pressing angle and thus the force of pre-pressing the resting surface 67 of the base. So, the elastic arm 71 of the male terminal 70 is only caused to move inwards but not downwards to touch the first circuit board 33 when the male base 60 is combined with the female base 40.

While the invention has been described by way of example and in terms of a preferred embodiment, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. An electrical connector, comprising:

a female base formed with a concave portion and a plurality of separately disposed female terminal slots;

a plurality of female terminals, which is respectively assembled in the female terminal slots of the female base and is integrally formed by pressing a metal sheet, wherein each of the female terminals comprises a contact, a fixing portion fixed in the female terminal slot, and a pin portion extending out of the female base;

a male base, which has a central portion assembled in the concave portion of the female base and is formed with a plurality of separately disposed male terminal slots; and a plurality of male terminals, which is respectively assembled in the male terminal slots of the male base and is integrally formed by pressing another metal sheet, wherein:

each of the male terminals comprises an elastic arm having a projecting contact to be electrically connected to the contact of the female terminal, a fixing portion fixed in the male terminal slot, and a pin portion extending out of the male base;

the central portion of the male base is formed with one resting surface corresponding to each of the male terminal slots;

the elastic arm of the male terminal is formed with a laterally protruding supporting foot resting against the resting surface of the male base to make the contacts of the male terminals be located at the same level; and the supporting foot of the male terminal laterally protrudes from a middle of the elastic arm.

2. The electrical connector according to claim 1, wherein the pin portion of the female terminal horizontally extends out of the female base, and the pin portion of the male terminal horizontally extends out of the male base.

3. The electrical connector according to claim 1, wherein the male base has two side portions, and the two side portions and the central portion form two concave portions.

4. The electrical connector according to claim 1, wherein the elastic arm of the male terminal is formed with a pre-pressing angle toward the resting surface such that the elastic arm of the male terminal has a force of pre-pressing the resting surface of the male base.

5. The electrical connector according to claim 1, wherein the resting surface of the male base is substantially horizontal, and the supporting foot of the male terminal is also substantially horizontally in contact with the resting surface.

6. An electrical connector, comprising:

a base having a plurality of separately disposed terminal slots; and a plurality of terminals, which is respectively assembled in the terminal slots of the base and integrally formed by pressing a metal sheet, wherein:

each of the terminals comprises an elastic arm having a projecting contact, a fixing portion fixed in the terminal slot, and a pin portion extending out of the base;

the base is formed with a resting surface corresponding to each of the terminal slots;

the elastic arm of the terminal is formed with a laterally protruding supporting foot resting against the resting surface of the base to make the contacts of the terminals be located at the same level; and the supporting foot of the terminal laterally protrudes from a middle of the elastic arm.

7. The electrical connector according to claim 6, wherein the pin portion of the terminal horizontally extends out of the base.

8. The electrical connector according to claim 6, wherein the elastic arm of the terminal is formed with a pre-pressing angle toward the resting surface such that the elastic arm of the terminal has a force of pre-pressing the resting surface of the base.

9. The electrical connector according to claim 6, wherein the resting surface of the base is substantially horizontal, and the supporting foot of the terminal is also substantially horizontally in contact with the resting surface.

* * * * *